US010361527B2

(12) United States Patent
Schmidt et al.

(10) Patent No.: US 10,361,527 B2
(45) Date of Patent: Jul. 23, 2019

(54) ELECTRICAL TERMINAL AND DEVICE FOR FORMING A TERMINAL

(71) Applicants: TYCO ELECTRONICS CORPORATION, Berwyn, PA (US); TE CONNECTIVITY GERMANY GmbH, Bensheim (DE)

(72) Inventors: Helge Schmidt, Speyer (DE); Marjorie Kay Myers, Mount Wolf, PA (US); David Alan College, Annville, PA (US)

(73) Assignees: TE CONNECTIVITY CORPORATION, Berwyn, PA (US); TE CONNECTIVITY GERMANY GMBH, Bensheim (DE)

( * ) Notice: Subject to any disclaimer, the term of this patent is extended or adjusted under 35 U.S.C. 154(b) by 92 days.

(21) Appl. No.: 15/046,815

(22) Filed: Feb. 18, 2016

(65) Prior Publication Data

US 2016/0248212 A1 Aug. 25, 2016

Related U.S. Application Data

(60) Provisional application No. 62/120,699, filed on Feb. 25, 2015.

(51) Int. Cl.
*H01R 4/18* (2006.01)
*H01R 4/62* (2006.01)
(Continued)

(52) U.S. Cl.
CPC ..... *H01R 43/048* (2013.01); *H01R 4/184* (2013.01); *H01R 4/188* (2013.01); *H01R 43/058* (2013.01); *H01R 4/62* (2013.01)

(58) Field of Classification Search
CPC ..... H01R 43/058; H01R 4/184; H01R 4/20; H01R 43/048
See application file for complete search history.

(56) References Cited

U.S. PATENT DOCUMENTS 4,890,384 A 1/1990 Shaffer
2014/0317922 A1 10/2014 Schmidt et al.

FOREIGN PATENT DOCUMENTS

DE 10 2006 045567 A1 4/2008
DE 10 2012 216780 A1 3/2014
(Continued)

OTHER PUBLICATIONS

Machine Translation of DE102012216780A1, obtained Jan. 19, 2018.*
International Search Report, Application No. PCT/US2016/019009, International Filing Date, Feb. 23, 2016.

*Primary Examiner* — Livius Radu Cazan

(57) ABSTRACT

A crimping device includes an anvil and a crimp tooling member. The anvil is configured to receive a terminal on a top surface thereof. The crimp tooling member has a forming profile recessed from a bottom side of the crimp tooling member. The forming profile is configured to engage a crimp barrel of the terminal as the crimp tooling member moves towards the anvil during a crimping operation to crimp the crimp barrel into mechanical and electrical engagement with an electrical wire disposed within the crimp barrel. The forming profile defines at least one pocket along a top-forming surface of the forming profile that extends between two side walls of the forming profile. Each pocket is configured to form a corresponding protrusion in the crimp barrel of the terminal during the crimping operation.

19 Claims, 6 Drawing Sheets

(51) Int. Cl.
*H01R 43/048* (2006.01)
*H01R 43/058* (2006.01)

(56) References Cited

FOREIGN PATENT DOCUMENTS

| | | | | | |
|---|---|---|---|---|---|
| DE | 102012216780 | A1 | * | 3/2014 | ..... H01R 4/20 |
| EP | 01081810 | A1 | | 8/2000 | |
| EP | 1081810 | A1 | * | 3/2001 | ..... H01R 43/058 |
| JP | S61114688 | U | | 7/1986 | |
| JP | 04115481 | A | * | 4/1992 | |
| JP | H04115481 | A | | 4/1992 | |
| JP | H05303983 | A | | 11/1993 | |
| JP | H08339839 | A | | 12/1996 | |
| JP | 2003059612 | A | * | 2/2003 | |
| JP | 2009087848 | A | * | 4/2009 | |
| JP | 2009087848 | A | | 4/2009 | |
| KR | 20140093977 | A | | 7/2014 | |

* cited by examiner

ELECTRICAL TERMINAL AND DEVICE FOR FORMING A TERMINAL

CROSS-REFERENCE TO RELATED APPLICATIONS

This application claims priority to U.S. Provisional Application No. 62/120,699, filed 25 Feb. 2015, which is incorporated by reference in its entirety.

BACKGROUND OF THE INVENTION

The subject matter described and/or illustrated herein relates generally to crimp tooling of crimping devices for forming terminals around electrical wires to produce terminal assemblies, and to the formed terminals.

Electrical terminals are often used to terminate the ends of wires. Such electrical terminals typically include an electrical contact and a crimp barrel. In some terminals, the crimp barrel includes an open area that receives an end of the wire therein. The crimp barrel is crimped around the end of the wire to establish an electrical connection between electrical conductors in the wire and the terminal as well as to mechanically hold the electrical terminal on the wire end. When crimped over the wire end, the crimp barrel establishes an electrical and mechanical connection between the conductors of the wire and the electrical contact.

Conductors of wires are often fabricated from copper, copper alloys, copper clad steel, etc. However, as the cost of copper has risen, aluminum represents a lower cost alternative conductor material. Aluminum also has a lighter weight than copper, so aluminum represents a lower weight alternative conductor material as well. But, using aluminum as a conductor material is not without disadvantages. For example, one disadvantage of using aluminum as a conductor material is that it forms a tightly adherent, poorly conductive oxide layer on the exterior surface of the conductor when the conductor is exposed to atmosphere. In addition, build-up of surface contaminants from processing steps may further inhibit surface conductivity. Such oxide and/or other surface contaminates may be formed on other conductor materials, but can be especially difficult to deal with for aluminum. Accordingly, such exterior conductor surface oxide layers must be penetrated to contact the aluminum material to establish a reliable electrical connection between a wire and an electrical terminal and/or to establish a reliable electrical connection between different conductors of the wire. For example, as a conductor wipes against another conductor and/or the electrical terminal during crimping, at least a portion of the oxide layer of the conductor(s) may be displaced to expose the aluminum material of the conductor(s). But, it may be difficult to displace enough of the oxide layer during the crimping operation to achieve a sufficient electrical and mechanical bond, and thereby establish a reliable electrical connection, especially for larger diameter wires that include a greater amount of electrical conductors.

BRIEF DESCRIPTION OF THE INVENTION

In an embodiment, a crimping device is provided that includes an anvil and a crimp tooling member. The anvil has a top surface. The anvil is configured to receive a terminal on the top surface. The crimp tooling member is moveable towards and away from the anvil along a crimp stroke. The crimp tooling member has a forming profile recessed from a bottom side of the crimp tooling member. The forming profile includes two side walls extending from the bottom side towards an opposite top side of the crimp tooling member. The forming profile is configured to engage a crimp barrel of the terminal as the crimp tooling member moves towards the anvil during a crimping operation to crimp the crimp barrel into mechanical and electrical engagement with an electrical wire disposed within the crimp barrel. The forming profile defines at least one pocket along a top-forming surface of the forming profile that extends between the two side walls. Each pocket is configured to form a corresponding protrusion in the crimp barrel of the terminal during the crimping operation.

In an embodiment, a terminal assembly is provided that includes an electrical wire and an electrical terminal. The electrical wire includes electrical conductors. The electrical terminal has a crimp barrel extending between a proximal end and a distal end. The crimp barrel is crimped to an electrical wire such that the crimp barrel surrounds and mechanically and electrically engages electrical conductors of the electrical wire to secure the terminal to the electrical wire. The crimp barrel includes at least one crimp-formed protrusion extending from a top exterior surface of the crimp barrel.

DETAILED DESCRIPTION OF THE INVENTION

Figure 1:
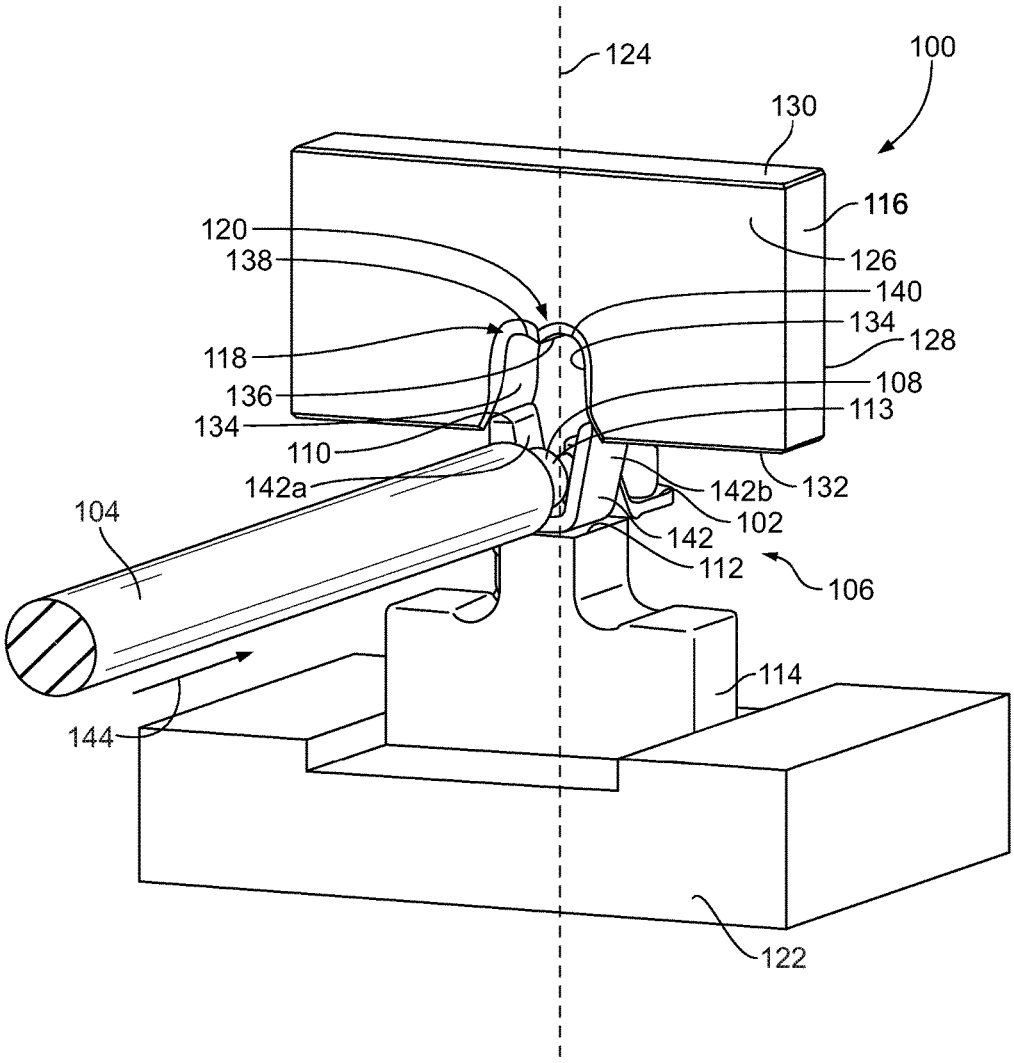
FIG. 1 is a perspective view of an embodiment of a crimping device.

FIG. 1 is a perspective view of an embodiment of a crimping device 100. The crimping device 100 crimps an electrical terminal 102 to an electrical wire 104. The electrical terminal 102 and the electrical wire 104 form a terminal assembly 106. In an embodiment, the electrical wire 104 has electrical conductors 108 that are received in a crimp barrel 110 of the terminal 102. For example, an end segment 113 of the wire 104 has exposed conductors 108 that are loaded into the crimp barrel 110. During a crimping operation, the barrel 110 is crimped around the conductors 108 forming a mechanical and electrical connection between the terminal 102 and the electrical wire 104.

The crimping operation entails forming the terminal to mechanically hold the conductors within the terminal and to provide electrical engagement between the conductors and the terminal. Forming of the terminal may include bending arms or tabs around the wire conductors as in an open terminal (e.g., "F" type crimp) or compressing a closed barrel around the wire conductors as in a closed terminal (e.g., "O" type crimp). As the terminal is formed around the wires during the crimping action, the metal of the terminal and/or of the conductors within the terminal may be extruded. It is desirable to provide a secure mechanical connection and a good quality electrical connection between the terminal and the electrical wire. Using the embodiments of crimp tooling as disclosed herein creates a formed feature on the terminal that is formed during the crimping operation due to the extrusion of the metal(s). With this tooling, the formed feature can be formed on various types of terminals with varying terminal shapes and designs.

The crimping device 100 includes an anvil 114 and a crimp tooling member 116. In the illustrated embodiment, the anvil 114 is located on a base support 122. The anvil 114 has a top surface 112 that receives the terminal 102 thereon. The electrical conductors 108 of the wire 104 are received in the crimp barrel 110 of the terminal 102 on the anvil 114. The crimp tooling member 116 includes a forming profile 118 that is selectively shaped to form or crimp the barrel 110 around the conductors 108 when the forming profile 118 engages the terminal 102. The forming profile 118 defines part of a crimp zone 120 in which the terminal 102 and wire 104 are received during the crimping operation. The top surface 112 of the anvil 114 also defines a part of the crimp zone 120, as the terminal 102 is crimped to the wire 104 between the crimp tooling member 116 and the anvil 114.

The crimp tooling member 116 is movable towards and away from the anvil 114 along a crimp stroke. The crimp stroke has an upward component away from the anvil 114 and a downward component towards the anvil 114. The crimp tooling member 116 moves bi-directionally, towards and away from the anvil 114, along a crimp axis 124. The crimp tooling member 116 forms the terminal 102 around the electrical conductors 108 during the downward component of the crimp stroke as the crimp tooling member 116 moves towards the anvil 114. Although not shown in FIG. 1, the crimp tooling member 116 may be coupled to a mechanical actuator that propels the movement of the crimp tooling member 116 along the crimp stroke. For example, the crimp tooling member 116 may be coupled to a movable ram of an applicator or lead-maker machine. In addition, the applicator or the lead-maker machine may also include or be coupled to the anvil 114 and the base support 122 of the crimping device 100.

The crimp tooling member 116 extends longitudinally between a front side 126 and a rear side 128. The crimp tooling 116 extends vertically between a top side 130 and a bottom side 132. As used herein, relative or spatial terms such as "top," "bottom," "front," "rear," "left," and "right" are only used to distinguish the referenced elements and do not necessarily require particular positions or orientations in the crimping device 100 or in the surrounding environment of the crimping device 100. The forming profile 118 is defined along the bottom side 132 of the crimp tooling member 116. For example, the forming profile 118 extends upwards at least partially towards the top side 130 from the bottom side 132. The forming profile 118 includes two side walls 134 that extend from the bottom side 132 and a top-forming surface 136 that extends between the two side walls 134. The top-forming surface 136 in FIG. 1 has a double-arch or "m" shape. For example, the top-forming surface 136 defines a left arch 138 and a right arch 140. The top-forming surface 136 extends at least part of the length of the crimp tooling member 116 between the front side 126 and the rear side 128.

In an embodiment, the crimp barrel 110 is at least partially defined by two tabs 142. During a crimping operation, the terminal 102 is loaded onto the top surface 112 of the anvil 114. The wire 104 is moved in a loading direction 144 towards the crimp zone 120 such that the electrical conductors 108 are received in the crimp barrel 110 of the terminal 102 between the two tabs 142. As the crimp tooling member 116 moves toward the anvil 114, the forming profile 118 descends over the crimp barrel 110 and engages the tabs 142 to bend or form the tabs 142 around the electrical conductors 108. More specifically, the side walls 134 and the top-forming surface 136 of the forming profile 118 gradually bend the tabs 142 over a top of the electrical conductors 108 as the crimp tooling member 116 moves downward. The left arch 138 is configured to engage and bend a left tab 142A of the tabs 142 of the terminal 102, while the right arch 140 is configured to engage and bend a right tab 142B of the tabs 142. At a bottom dead position of the crimp tooling member 116, which is the lowest position (or most proximate position to the base support 122) of the crimp tooling member 116 during the crimp stroke, part of the forming profile 118 may extend beyond the top surface 112 of the anvil 114. The terminal 102 is compressed between the forming profile 118 and the anvil 114, which causes the tabs 142 of the terminal 102 to mechanically engage and electrically connect to the electrical conductors 108 of the wire 104, forming the terminal assembly 106. High compressive forces cause metal-to-metal bonds between the tabs 142 and the conductors 108. One or more embodiments described herein are directed to controlling the compression of the tabs 142 and the electrical conductors 108 to improve mechanical and electrical conductive properties of the resulting metal-to-metal bonds or junctions as compared to known terminal assemblies.

Figure 2:
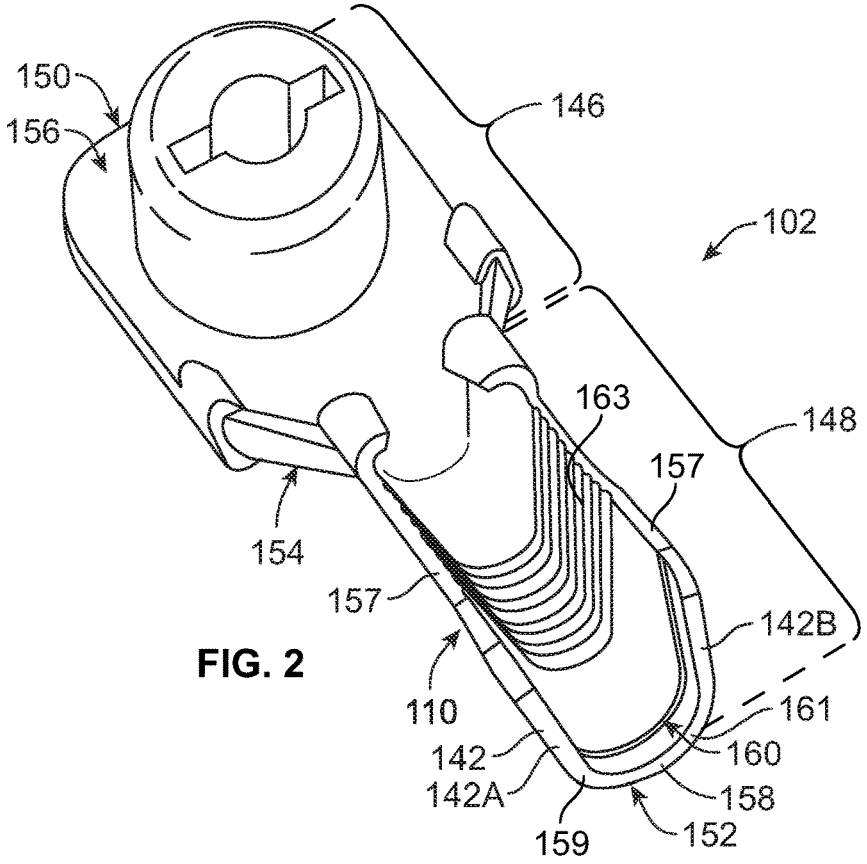
FIG. 2 is a perspective view of an embodiment of an electrical terminal according to an embodiment.

FIG. 2 is a perspective view of an embodiment of the electrical terminal 102 prior to the crimping operation. The terminal 102 extends between a distal end 150 and a proximal end 152. The terminal 102 includes an electrical contact portion 146 and a crimp portion 148. The contact portion 146 extends to the distal end 150 of the terminal 102, and the crimp portion 148 extends to the proximal end 152. The contact portion 146 is separated from the crimp portion 148 by a transition region 154. The contact portion 146 includes an electrical contact 156. In the illustrated embodiment, the electrical contact 156 is a receptacle that is configured to receive a mating contact (not shown) therein, such as a bus or battery terminal. The electrical contact 156 is not limited to the electrical contact 156 shown herein, but rather the terminal 102 may include any type of electrical contact 156, such as, but not limited to, a socket, a spring contact, a beam contact, a tab, a structure having an opening for receiving a threaded or other type of mechanical fastener, and/or the like.

The crimp portion 148 includes the crimp barrel 110. The barrel 110 includes the tabs 142 and a base 158. The tabs 142 extend from the base 158. The base 158 and the tabs 142 define an opening 160 of the barrel 110 that is configured to receive the end segment 113 (shown in FIG. 1) of the electrical wire 104 (FIG. 1) that includes the exposed electrical conductors 108 (FIG. 1). The barrel 110 is configured to be crimped around the end segment 113 to mechanically and electrically connect the electrical wire 104 to the electrical terminal 102. The tabs 142 may be integral to the base 158. For example, the left tab 142A is integral to and extends from a left edge 159 of the base 158, and the right tab 142B is integral to and extends from an opposite right edge 161 of the base 158. The left and right edges 159, 161 have smooth curves in FIG. 2, but may have more pronounced angles in other embodiments. The tabs 142A, 142B extend upward from the base 158 to respective ends 157 of the tabs 142A, 142B. The ends 157 are not in contact with any other components of the terminal 102 in the pre-crimped state of the terminal 102 shown in FIG. 2. The crimp portion 148 thus may have a "u" or "v" shaped cross-section that is open at the top. The crimp portion 148 optionally further includes serrations or grooves 163 along an interior surface to provide enhanced grip on the electrical conductors 108 in the crimp barrel 110.

In the illustrated embodiment, the terminal 102 is an "F" type terminal since the crimp barrel 110 is open at a top between the tabs 142. However, in one or more alternative embodiments, the terminal may be an "O" type terminal that includes a closed crimp barrel (such that the crimp barrel is not open along a top). For example, the closed crimp barrel may have a cylindrical or prismatic shape that receives electrical conductors of an electrical wire through an opening at an end of the crimp barrel. Instead of crimping the terminal to the wire by bending tabs, the forming profile 118 (shown in FIG. 1) of the crimp tooling member 116 (FIG. 1) may compress the closed crimp barrel into engagement with the conductors within the barrel.

The electrical terminal 102 may be fabricated from one or more conductive materials, such as, but not limited to, copper, a copper alloy, copper clad steel, aluminum, nickel, gold, silver, a metal alloy, and/or the like. One or more portions (e.g., the barrel 110) or all of the electrical terminal 102 may fabricated from a base metal and/or metal alloy that is coated (e.g., plated and/or the like) with another material (e.g., another metal and/or metal alloy). For example, a portion or an entirety of the electrical terminal 102 may be fabricated from a copper base that is plated with nickel. In an embodiment, the terminal 102 is stamped and formed out of a sheet or panel of metal.

Figure 3:
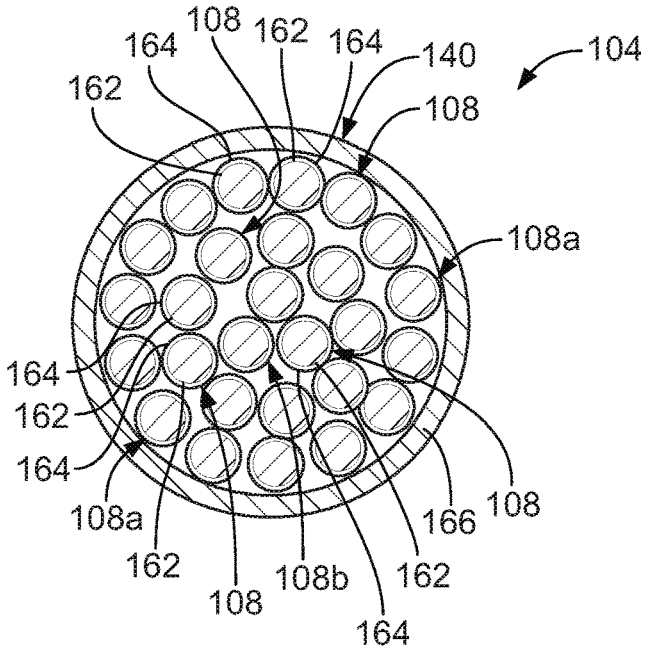
FIG. 3 is a cross-sectional view of an embodiment of an electrical wire that is configured to be crimped to the electrical terminal of FIG. 2.

FIG. 3 is a cross-sectional view of an embodiment of the electrical wire 104 that is configured to be crimped to the electrical terminal 102 of FIG. 2 to form the terminal assembly 106 (shown in FIG. 1). The electrical wire 104 shown in FIG. 3 is in a pre-crimped state, such that the wire 104 is not crimped to the terminal 102. The electrical wire 104 includes a group or bundle of electrical conductors 108 and an electrical insulation layer 166 that surrounds the group of electrical conductors 108. The electrical wire 104 may include any number of the electrical conductors 108. In an embodiment, the cross-sectional area of the bundle of conductors 108 is at least 10 $mm^2$. For example, the cross-sectional area of the bundle of conductors 108 may be up to or over 60 $mm^2$.

The electrical conductors 108 may be fabricated from any materials, such as, but not limited to, aluminum, an aluminum alloy, copper, a copper alloy, copper clad steel, nickel, gold, silver, a metal alloy, and/or the like. In the illustrated embodiment, the electrical conductors 108 are fabricated from aluminum. Aluminum provides a low weight and low cost alternative to copper, for example. One disadvantage, however, of using aluminum as an electrical conductor material is an oxide and/or other surface contaminant (such as, but not limited to, residual wire extrusion enhancement materials, and/or the like) layer that may form on the exterior metallic (i.e., aluminum) surface of the electrical conductors 108. The oxide and/or other surface contaminant layer may form, for example, when the conductors 108 are exposed to air and/or during processing (e.g., an extrusion process and/or the like) of the electrical conductors 108. Such oxide and/or other surface contaminate layers may be formed on other conductor materials besides aluminum, but can be particularly difficult to deal with for aluminum. It should be understood that the embodiments described and/or illustrated herein are applicable to and may be used with one or more of the electrical conductors 108 being fabricated from a material other than aluminum. Moreover, the embodiments described and/or illustrated herein will be described below with respect to oxide layers, but it should be understood that the methods and crimp tools described and/or illustrated herein may be used with respect to other surface material layers in addition or alternative to the oxide layers.

The electrical conductors 108 of the electrical wire 104 include a group of exterior electrical conductors 108*a* that form a perimeter of the group of electrical conductors 108. The electrical conductors 108 also include a group of interior electrical conductor 108*b* that are surrounded by the exterior electrical conductors 108*a*. Each electrical conductor 108 includes a metallic surface 162 that defines an exterior surface of the aluminum material of the electrical conductor 108. The electrical conductors 108 also include oxide layers 164 that are formed on the metallic surfaces 162 of the electrical conductors 108, for example when the electrical conductors 108 are exposed to air. The oxide layers 164 are less electrically conductive than the metallic surfaces 162. Accordingly, to establish a reliable electrical connection between one electrical conductor 108 and another electrical conductor 108 and/or the barrel 110 (shown in FIG. 1), the oxide layer 164 must be displaced during the crimping process to expose the metallic surface 162 of the electrical conductor 108 and allow the metallic surface 162 to make direct contact with the other conductor 108 and/or the barrel 110. The thickness of the oxide layers 164 may be exaggerated in FIG. 3 to better illustrate the oxide layers 164.

With additional reference to FIG. 1, as the tabs 142 of the terminal 102 press against the electrical conductors 108 of the end segment 113 of the wire 104, the electrical conductors 108 wipe, slide, or flow against adjacent electrical conductors 108 and the interior surfaces of the tabs 142. The wiping may displace and/or break open existing oxide layers 164 of the electrical conductors 108 and thereby expose the more conductive metallic surfaces 162 of the electrical conductors 108 to allow the formation of metal-to-metal bonds. For example, the movement of the electrical conductors 108 against each other and against the tabs 142 during the crimping operation creates frictional forces between adjacent electrical conductors 108 and between the exterior electrical conductors 108*a* and the tabs 142. As the electrical conductors 108 are compressed against each other and the tabs 142, and the attendant oxide displacement and/or metallic extrusion occurs, at least some "fresh" metallic surfaces 162 lacking oxide layers may bond or weld to one another. The bonds formed between fresh metallic surfaces 162 may be mechanically stronger and/or more conductive than bonds formed with intervening oxide layers 164.

With continued reference to FIG. 1, during a crimping operation, as the crimp tooling member 116 compresses the crimp barrel 110 and the electrical conductors 108 therein between the forming profile 118 and the anvil 114, at least some of the metal of the crimp barrel 110 and the conductors 108 is extruded longitudinally such that the metal stretches or flows to lower pressure areas. The extrusion causes the wiping described above. The extrusion of metal during a crimping operation is described herein with reference to flow, although it is recognized that the metal need not be in a liquid state. In some know crimping devices, the conductors and the tabs of the terminals have limited variation in the direction of flow during the crimping operation. For example, both the metal of the tabs and the metal of the conductors that are proximate to a proximal end of the terminal may flow towards and/or beyond the proximal end. Thus, the metals of the tabs and the adjacent conductors may slide or flow together in the same general direction such that there is not much relative movement between the tabs and the conductors. Since the relative movement is limited, the amount of wiping and friction between the metals of the tabs and the conductors (and between adjacent conductors) is also limited, so a reduced amount of oxide is displaced from the metal surfaces. In one or more embodiments herein, during the crimping process, the crimp barrel 110 and/or the conductors 108 are compressed such that the various metals have a more turbulent or differential flow than known crimping devices, which results in better wiping and better bonding between the metals of the terminal 102 and the wire 104.

Figure 4:
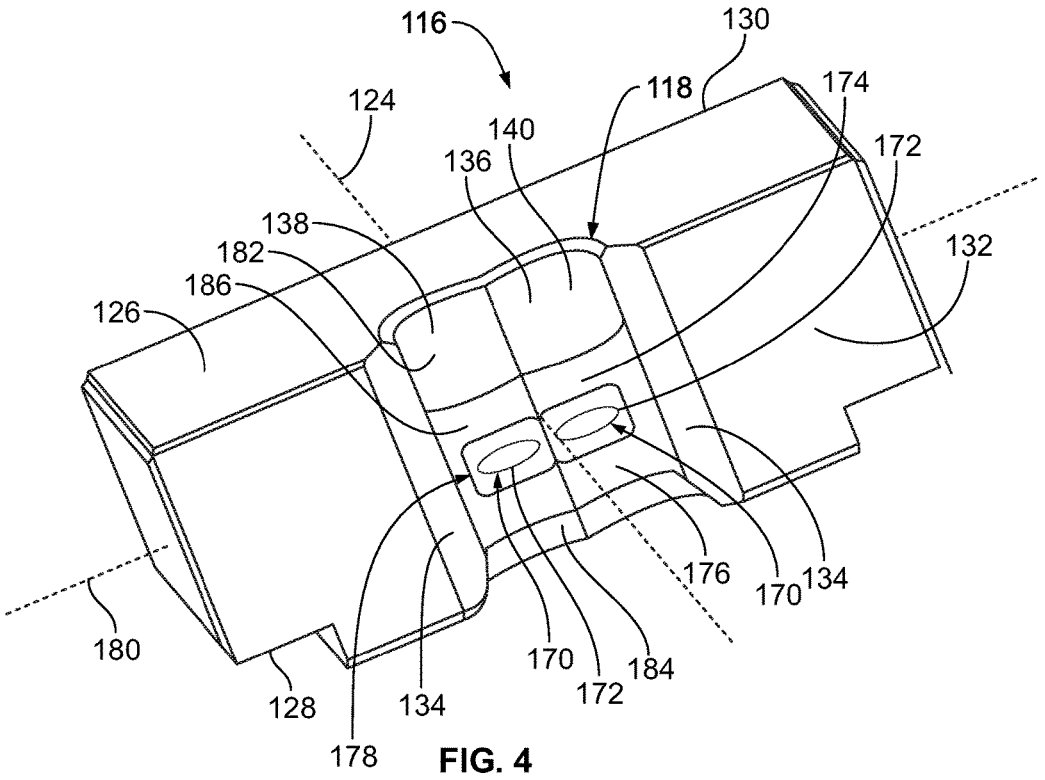
FIG. 4 is a bottom perspective view of a crimp tooling member of the crimping device according to an embodiment.

FIG. 4 is a bottom perspective view of the crimp tooling member 116 of the crimping device 100 (shown in FIG. 1) according to an embodiment. The forming profile 118 is defined along the bottom side 132 of the crimp tooling member 116. The forming profile 118 extends the length of the crimp tooling member 116 between the front side 126 and the rear side 128. The top-forming surface 136 and the side walls 134 of the forming profile 118 may be selectively shaped to create a desired crimp shape. For example, the side walls 134 are sloped laterally inwards such that a width of the forming profile 118 is greater at the bottom side 132 than at the interface between the side walls 134 and the top-forming surface 136. Thus, during the crimping operation, the side walls 134 each engage a corresponding tab 142 (shown in FIG. 1) of the terminal (FIG. 1) and start to bend the tabs 142, while the top-forming surface 136 subsequently engages the tabs 142 and continues to bend the tabs 142 to press the tabs 142 against the electrical conductors 108 (FIG. 1) of the wire 104 (FIG. 1). In the illustrated embodiment, the forming profile 118 is symmetric about the crimp axis 124, and is configured to create an "F" type crimp. However, the forming profile 118 may be shaped differently in other embodiments to achieve other types of crimps.

Figure 5:
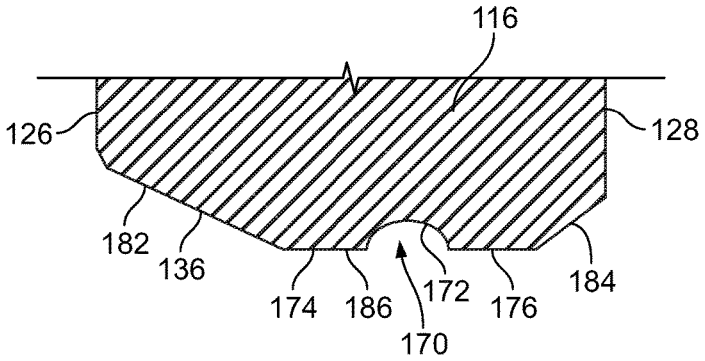
FIG. 5 is a cross-sectional view of the crimp tooling member according to an embodiment.

In an embodiment, the crimp tooling member 116 defines at least one pocket 170 that extends from the top-forming surface 136. The crimp tooling member 116 in the illustrated embodiment includes two pockets 170, although the crimp tooling member 116 may have one or more than two pockets 170 in other embodiments. The pockets 170 are depressions in the top-forming surface 136. The depressions have a bulbous shape in the illustrated embodiment, although the depressions of the pockets 170 may have other shapes in other embodiments. An interior portion 172 of each pocket 170 is more proximate to the top side 130 of the crimp tooling member 116 (and farther from the anvil 114 shown in FIG. 1) than other portions of the top-forming surface 136. For example, and as shown in FIG. 5, the interior portion 172 of each pocket 170 is farther from the anvil 114 than a front portion 174 of the top-forming surface 136 that is in front of the pocket 170 (for example, between the pocket 170 and the front side 126) along a longitudinal axis of the crimp tooling member 116. In addition, the interior portion 172 of each pocket 170 is farther from the anvil 114 than a rear portion 176 of the top-forming surface 136 that is in rear of the pocket 170. The pockets 170 are configured to form corresponding formed features (for example, protrusions 196 shown in FIG. 6) in the terminal 102 (shown in FIG. 1) during the crimping operation.

The crimp tooling member 116 in the illustrated embodiment defines one pocket 170 that extends from the left arch 138 of the top-forming surface 136, and one pocket 170 that extends from the right arch 140 of the top-forming surface 136. The two pockets 170 may be aligned side-by-side in a row 178. The row 178 extends parallel to a lateral axis 180 of the crimp tooling member 116. Alternatively, the crimp tooling member 116 may include multiple pockets 170 along one or both arches 138, 140 and the multiple pockets 170 may be aligned in rows.

Figure 8:
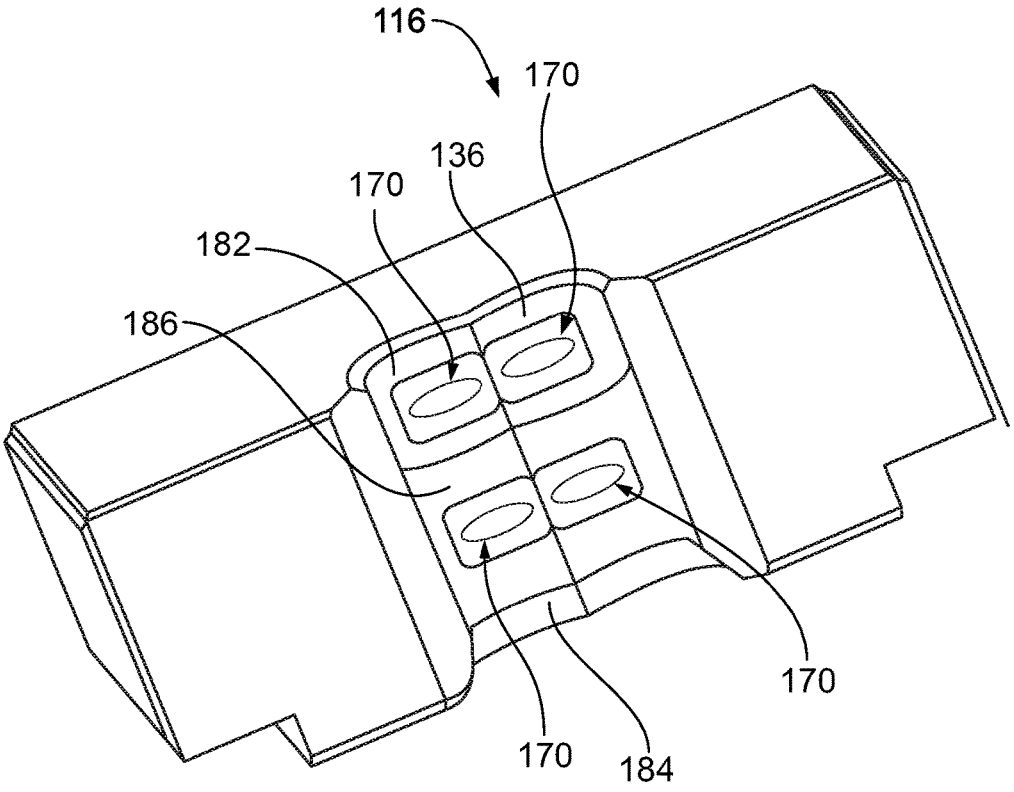

In an embodiment, the top-forming surface 136 defines a front flared section 182, a rear flared section 184, and an intermediary section 186 disposed therebetween. The front flared section 182 is at least proximate to the front side 126 of the crimp tooling member 116, and the rear flared section 184 is at least proximate to the rear side 128. The front flared section 182 and the rear flared section 184 are angled transverse to the intermediary section 186. For example, the flared sections 182, 184 extend gradually towards the top side 130 of the crimp tooling member 116 with increasing distance from the intermediary section 186. The front and rear flared sections 182, 184 are configured to provide a gradual strain relief in the crimp in directions leading away from an area of high crimp stress along the intermediary section 186, as described in more detail herein. In the illustrated embodiment, the pockets 170 are defined along the intermediary section 186. In alternate embodiments, pockets may be defined along one or both flared sections 182, 184 in addition to, or instead of, the intermediary section 186. For example, FIG. 8 is a bottom perspective view of the crimp tooling member 116 of the crimping device 100 (shown in FIG. 1) according to an alternative embodiment. In FIG. 8, the top-forming surface 136 defines the front flared section 182, the rear flared section 184, and the intermediary section 186, as shown in FIG. 4. The top-forming surface 136 defines pockets 170 along both the intermediary section 186 and the front flared section 182. In one or more alternative embodiments, the top-forming surface 136 does not include both the front and rear flared section 182, 184. For example, the top-forming surface 136 may include only the front flared and intermediary sections 182, 186, only the rear flared and intermediary sections 184, 186, or only the intermediary section 186 and neither of the flared sections 182, 184.

FIG. 5 is a cross-sectional view of the crimp tooling member 116 according to an embodiment. The illustrated cross-section shows the longitudinal profile of the top-forming surface 136 of the forming profile 118 (shown in FIG. 4) taken along a longitudinal axis. The top-forming surface 136 in the illustrated embodiment includes the front flared section 182 that extends from the front side 126, the intermediary section 186, and the rear flared section 184 that extends to the rear side 128. The intermediary section 186 defines a pocket 170 between a front portion 174 and a rear portion 176 of the top-forming surface 136 within the intermediary section 186. In an embodiment, the front portion 174 and the rear portion 176 both extend generally linearly along the longitudinal profile. Although the interior portion 172 that defines the pocket 170 is non-linear, the intermediary section 186 may be linear along the portions 174, 176 surrounding the pocket 170.

Figure 6:
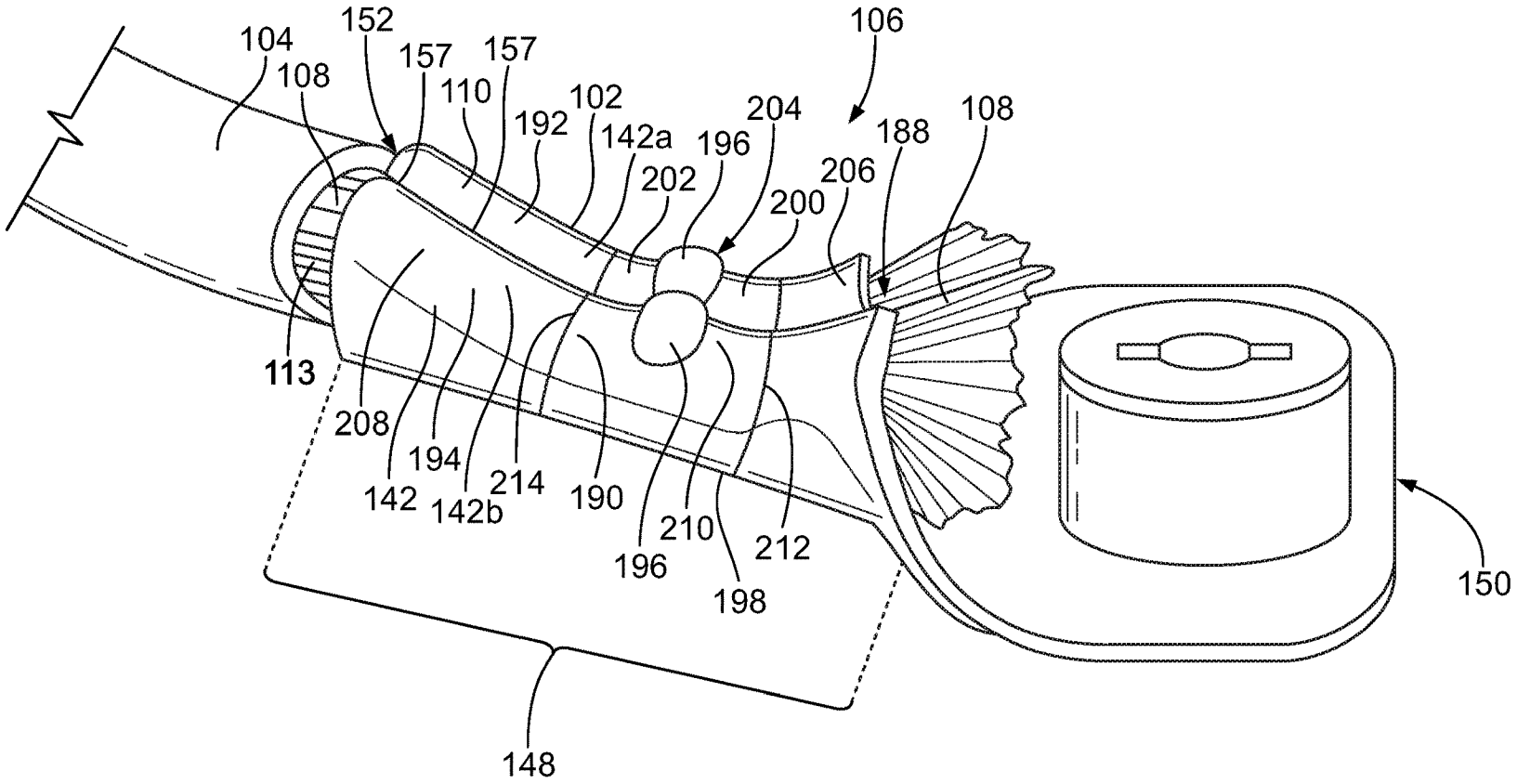
FIG. 6 is a perspective view of a terminal assembly formed during a crimping operation of the crimping device shown in FIG. 1.

FIG. 6 is a perspective view of a terminal assembly 106 formed during a crimping operation of the crimping device 100 shown in FIG. 1. Specifically, FIG. 6 shows the terminal 102 after the barrel 110 has been crimped around the conductors 108 at the end segment 113 of the electrical wire 104. The tabs 142 of the crimp portion 148 of the terminal 102 are bent and folded to surround and engage the electrical conductors 108. The tabs 142 are mechanically secured to the electrical conductors 108. The ends 157 of the tabs 142 engage one another over a top 188 of the electrical conductors 108. Optionally, the ends 157 of the tabs 142 may at least partially overlap one another. A top exterior surface 190 of the crimp portion 148 is formed by the top-forming surface 136 (shown in FIG. 4) of the forming profile 118 (FIG. 4) of the crimp tooling member 116 (FIG. 4). The shape of the top exterior surface 190 complements the top-forming surface 136. In an embodiment, the top exterior surface 190 has a double-arch shape that is defined by the left and right arches 138, 140 (shown in FIG. 4) of the forming profile 118. The left tab 142A defines a first arch 192 of the double-arch shape, and the right tab 142B defines a second arch 194.

In an embodiment, the crimp portion 148 of the terminal 102 defines at least one formed feature that is formed by the crimp tooling member 116 (shown in FIG. 1) during the crimping operation. In the illustrated embodiment, the formed features are protrusions 196 that extend outward from the top exterior surface 190. The terminal 102 shown in FIG. 6 includes two protrusions 196. The protrusions 196 are formed by, and complementary to, the pockets 170 (shown in FIG. 4) of the crimp tooling member 116 (FIG. 4). The protrusions 196 may have any projecting shape, such as a bulge, a knob, a ridge, a rib, a cylindrical shape, a rectangular prism shape, or the like. Each protrusion 196 extends farther from a bottom exterior surface 198 of the terminal 102 than a surrounding area of the top exterior surface 190. For example, the protrusion 196 extends farther from the bottom exterior surface 198 than a distal portion 200 of the top exterior surface 190 that is distal of the protrusion 196 (for example, closer to the distal end 150 of the terminal 102). The protrusion 196 also extends farther from the bottom exterior surface 198 than a proximal portion 202 of the top exterior surface 190 that is proximal of the protrusion 196 (for example, closer to the proximal end 152 of the terminal 102). The distal and proximal portions 200, 202 refer to the portions of the top exterior surface 190 that immediately surround the protrusions 196, and do not refer to flared sections of the terminal 102. The terminal 102 may include at least one protrusion 196 extending from the top exterior surface 190 along each of the first arch 192 and the second arch 194. In the illustrated embodiment, the terminal 102 includes two protrusions 196, one on each of the arches 192, 194, and the two protrusions 196 are aligned side-by-side to define a row 204. The row 204 corresponds to the row 178 (shown in FIG. 4) of the pockets 170 (FIG. 4) of the crimp tooling member 116 (FIG. 4). As stated above, other embodiments may include other numbers and arrangements of protrusions 196 along the top exterior surface 190 of the terminal 102. As used herein, the protrusions 196 are referred to as bulges 196, although the protrusions 196 are not limited to a curved, bulging shape.

Figure 7:
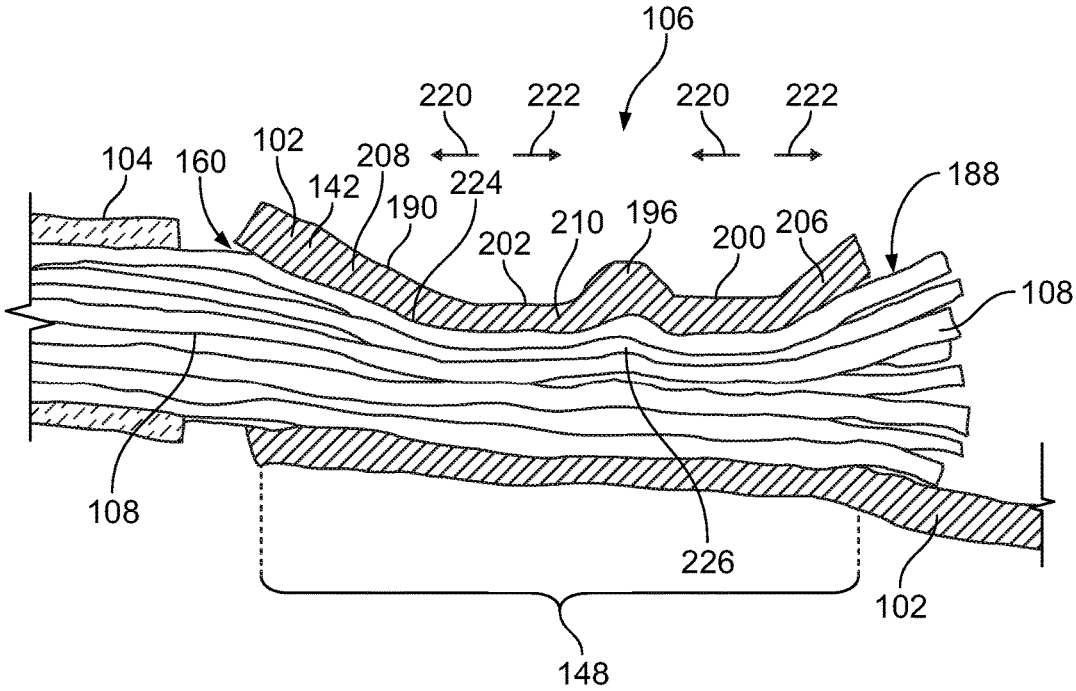
FIG. 7 is a cross-sectional view of a portion of the terminal assembly shown in FIG. 6.

In an embodiment, the top exterior surface 190 of the terminal 102 defines a distal flared section 206 at least proximate to the distal end 150 and a proximal flared section 208 at least proximate to the proximal end 152. A section between the distal flared section 206 and the proximal flared section 208 is referred to as a clamping section 210. The clamping section 210 generally has a smaller diameter or cross-sectional area than the flared sections 206, 208 and defines a high stress area along the crimp portion 148. The clamping section 210 is separated from the distal flared section 206 by a first lip 212, and is separated from the proximal flared section 208 by a second lip 214. A height of the terminal 102 is defined between the top exterior surface 190 and the bottom exterior surface 198. As shown in FIGS. 6 and 7, the height of the terminal 102 gradually decreases along the proximal flared section 208 in a direction from the proximal end 152 towards the second lip 214, and the height of the terminal 102 gradually increases along the distal flared section 206 from the first lip 212 towards the distal end 150 of the terminal 102. The distal and proximal flared sections 206, 208 provide a path for gradual strain relief on both ends of the high stress clamping section 210. Thus, during a crimping operation, at least some of the metal of the electrical conductors 108 and the tabs 142 may be extruded from the high pressure clamping section 210 outwards along the distal flared section 206 and/or proximal flared section 208. In an alternative embodiment, the terminal 102 includes only one flared section instead of both the distal and the proximal flared sections 206, 208. In another alternative embodiment, the terminal 102 may not include any flared sections.

FIG. 7 is a cross-sectional view of a portion of the terminal assembly 106 shown in FIG. 6. The cross-section shows a longitudinal profile of the terminal assembly 106. The electrical conductors 108 of the electrical wire 104 extend longitudinally within the opening 160 of the crimp portion 148 of the terminal 102. During the crimping operation, the crimp tooling member 116 (shown in FIG. 1) compresses the tabs 142 onto the top 188 of the electrical conductors 108. The pressure due to the compressive forces extrudes the metals of the conductors 108 and the tabs 142, causing the metals to flow, slide, or otherwise move to regions of reduced pressure. The regions of reduced pressure are the front flared section 182 (shown in FIG. 4), the rear flared section 184 (FIG. 4), and the pockets 170 (FIG. 4) along the top-forming surface 136 (FIG. 4) of the crimp tooling member 116. Thus, the metal along the clamping section 210 of the terminal 102, including the metal of the tabs 142 and/or the metal of the conductors 108, is forced towards the distal flared section 206, the proximal flared section 208, and the bulges 196 during the crimping operation. For example, as shown in FIG. 7, some metal that is aligned with the distal portion 200 of the top exterior surface 190 of the terminal 102 flows in a proximal direction 220 towards the bulge 196, and some metal aligned with the distal portion 200 flows in a distal direction 222 towards the distal flared section 206. Likewise, some metal that is aligned with the proximal portion 202 of the top exterior surface 190 flows in the distal direction 222 towards the bulge 196, and some metal aligned with the proximal portion 202 flows in the proximal direction 220 towards the proximal flared section 208.

Due to the flow or extrusion of metal, the pockets 170 (shown in FIG. 4) of the crimp tooling member 116 (FIG. 4) fill at least partially with extruded metal during the crimping operation. The metal that fills the pockets 170 may be attributable to the tabs 142 of the terminal 102 and/or the electrical conductors 108. For example, the terminal 102 has a wall thickness over the top 188 of the electrical conductors 108 that is defined between the top exterior surface 190 and a top interior surface 224 of the tabs 142. The top interior surface 224 engages the electrical conductors 108. The wall thickness of the terminal 102 may be greater along the bulge 196 than along the distal portion 200 and along the proximal portion 202 on either side of the bulge 196. The greater thickness of the terminal 102 along the bulge 196 indicates that at least some metal from the terminal 102 flows into the pocket 170 from the surrounding areas at least partially filling the pocket 170 to form the bulge 196. In addition, at least some of the electrical conductors 108 may be thicker in segments that align with the bulge 196 than in segments disposed remote from the bulge 196. For example, as shown in FIG. 7, at least some of the conductors 108 may have an undulation 226 in the longitudinal profile that aligns with the corresponding bulge 196, and the undulation 226 may have a greater thickness than other segments of the same conductors 108. The undulations 226 indicate that the metal of the conductors 108 may flow towards the pocket 170, and not only towards the flared sections 206, 208 of the terminal 102 during the crimping operation. Thus, at least some of the metal that fills the pocket 170 to form the bulge 196 may be attributable to the undulations 226 of the conductors 226.

As shown in FIG. 7, the flow of metal during the crimping operation to form the terminal assembly 106 is more turbulent than in known terminal assemblies. For example, instead of merely stretching and/or sliding towards the longitudinal ends, at least some of the metal of the terminal 102 and/or the conductors 108 flows towards the pockets 170 (shown in FIG. 4), which forms the bulges 196. Although the cross-section shown in FIG. 7 only shows binary flow in the proximal direction 220 and the distal direction 222, it is recognized that the pockets 170 are three-dimensional, so metal may flow towards the bulge 196 from all directions surrounding the bulge 196 (and not only from the indicated distal and proximal portions 200, 202). Therefore, during the crimping operation, the metal of the terminal 102 and the conductors 108 flows in various directions, providing a differential extrusion flow. The differential extrusion flow increases the frictional forces between the contacting metals, as opposed to metals that slide generally in the same direction. The increased frictional forces provide more energy to break the oxide layers 164 (shown in FIG. 3) that surround the metallic aluminum surfaces 162 (FIG. 3) of the conductors 108 as the metals wipe against each other, producing strong metal-to-metal bonds that have a low conductive resistance. Thus, the pockets 170 in the crimp tooling member 116 (shown in FIG. 4) may increase the turbulence of the extrusion flow during the crimping operation, which results in enhanced wiping and stronger, more conductive, metal-to-metal bonds than other known terminal assemblies.

The differential extrusion flow may also be enhanced due to the electrical conductors 108 being formed of a different metal than the terminal 102. For example, the electrical conductors 108 may be aluminum, while the terminal 102 may include at least some copper. Aluminum is softer and has a different coefficient of expansion than copper. Thus, during the crimping operation, the aluminum conductors 108 may flow more than the tabs 142 of the terminal 102. For example, the metal of a segment of a conductor may flow a greater distance, at a greater flow rate, or a greater volume of metal may flow in the distal direction 222 than the metal of an adjacent segment of the terminal during the crimping operation due to the different properties of the metals. These different metal properties may effectively provide a gradient, differential flow, even in areas where the two metals flow in generally the same direction.

Although the terminal 102 in the illustrated embodiments includes a contact portion 146 (shown in FIG. 2) that is distal of the crimp portion 148, in one or more alternative embodiments the terminal may not include a contact portion. For example, the terminal may be configured to produce a splice terminal assembly that electrically connects two different wires. The terminal may include a single crimp portion that engages electrical conductors of both wires, or may include a different crimp portion for each wire. One of the wires may extend from the distal end of the terminal, and the other wire may extend from the proximal end. Such a terminal may include at least one bulge that is formed during the crimping operation by a corresponding pocket along a forming profile of a crimp tooling member, as described above.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A crimping device comprising:

an anvil having a top surface, the anvil configured to receive a terminal on the top surface; and a crimp tooling member moveable towards and away from the anvil along a crimp stroke, the crimp tooling member having a forming profile recessed from a bottom side of the crimp tooling member, the forming profile including two side walls extending from the bottom side towards an opposite top side of the crimp tooling member and a top-forming surface that extends between the two side walls, the forming profile configured to engage a crimp barrel of the terminal as the crimp tooling member moves towards the anvil during a crimping operation to crimp the crimp barrel into mechanical and electrical engagement with an electrical wire disposed within the crimp barrel, wherein the top-forming surface includes a flared section and an intermediary section adjacent to the flared section along a longitudinal axis of the crimp tooling member that extends between opposite front and rear sides of the crimp tooling member, the flared section angled transverse to the intermediary section along a longitudinal cross-sectional profile of the crimp tooling member, wherein the forming profile defines a first pocket and a second pocket along the top-forming surface, the first pocket disposed along the intermediary section, the second pocket disposed along the flared section, the first and second pockets configured to form corresponding protrusions in the crimp barrel of the terminal during the crimping operation, wherein the intermediary section of the top-forming surface includes a front portion that is in front of the first pocket along the longitudinal axis and a rear portion that is rearward of the first pocket along the longitudinal axis.

2. The crimping device of claim 1, wherein the first and second pockets are recessed from the top-forming surface of the forming profile towards the top side of the crimp tooling member such that an interior portion of each pocket is more proximate to the top side than a portion of the top-forming surface adjacent to the pocket relative to the top side.

3. The crimping device of claim 1, wherein the first and second pockets extend non-linearly along the longitudinal cross-sectional profile.

4. The crimping device of claim 1, wherein the flared section of the top-forming surface is a front flared section and the top-forming surface further includes a rear flared section, the intermediary section disposed between the front flared section and the rear flared section along the longitudinal axis.

5. The crimping device of claim 4, wherein the front flared section differs from the rear flared section in axial length and in angle of orientation relative to the intermediary section.

6. The crimping device of claim 1, wherein the top-forming surface of the forming profile has a double-arch shape that includes a left arch and a right arch, the left arch being configured to engage and bend a left tab of the crimp barrel of the terminal during the crimping operation, the right arch being configured to engage and bend a right tab of the crimp barrel of the terminal during the crimping operation.

7. The crimping device of claim 6, wherein the first pocket extends from one of the left arch or the right arch, and the second pocket extends from one of the left arch or the right arch.

8. The crimping device of claim 1, wherein the forming profile further defines a third pocket that is disposed along the intermediary section and is aligned side by side with the first pocket in a row.

9. The crimping device of claim 1, wherein the forming profile of the crimp tooling member is symmetric about a crimp axis.

10. The crimping device of claim 1, wherein the front and rear portions of the intermediary section linearly extend parallel to each other along the longitudinal cross-sectional profile of the crimp tooling member.

11. A crimping device comprising:

an anvil having a top surface, the anvil configured to receive a terminal on the top surface; and a crimp tooling member moveable towards and away from the anvil along a crimp stroke, the crimp tooling member having a forming profile recessed from a bottom side of the crimp tooling member, the forming profile configured to engage a crimp barrel of the terminal during a crimping operation, the forming profile including two side walls extending from the bottom side towards an opposite top side of the crimp tooling member and a top-forming surface that extends between the two side walls, the top-forming surface including a flared section and an intermediary section adjacent to the flared section along a longitudinal axis of the crimp tooling member that extends between opposite front and rear sides of the crimp tooling member, the flared section angled transverse to the intermediary section along a longitudinal cross-sectional profile of the crimp tooling member, wherein the forming profile defines a first pocket and a second pocket within the top-forming surface, the first pocket disposed along the flared section, the second pocket disposed along the intermediary section, the first and second pockets configured to form corresponding protrusions in the crimp barrel of the terminal during the crimping operation.

12. The crimping device of claim 11, wherein the flared section is a front flared section disposed between the intermediary section and the front side of the crimp tooling member along the longitudinal axis.

13. The crimping device of claim 11, wherein the flared section is a rear flared section disposed between the intermediary section and the rear side of the crimp tooling member along the longitudinal axis.

14. The crimping device of claim 11, wherein the intermediary section of the top-forming surface includes a front portion and a rear portion, the front portion extending from the second pocket towards the front side of the crimp tooling member, the rear portion extending from the second pocket towards the rear side of the crimp tooling member, the front and rear portions extending linearly and parallel to each other along the longitudinal cross-sectional profile of the crimp tooling member.

15. The crimping device of claim 11, wherein the top-forming surface of the forming profile has a double-arch shape that includes a left arch and a right arch, wherein the second pocket along the intermediary section is located on the left arch and the forming profile defines a third pocket along the intermediary section that is located on the right arch.

16. The crimping device of claim 11, wherein the top-forming surface of the forming profile has a double-arch shape that includes a left arch and a right arch, wherein the first pocket along the flared section is located on the left arch and the forming profile defines a third pocket along the flared section that is located on the right arch.

17. The crimping device of claim 11, wherein the intermediary section of the top-forming surface is oriented parallel to the bottom side of the crimp tooling member.

18. A crimping device comprising:

an anvil having a top surface, the anvil configured to receive a terminal on the top surface; and a crimp tooling member moveable towards and away from the anvil along a crimp stroke, the crimp tooling member having a forming profile recessed from a bottom side of the crimp tooling member, the forming profile including two side walls extending from the bottom side towards an opposite top side of the crimp tooling member and a top-forming surface that extends between the two side walls, the forming profile configured to engage a crimp barrel of the terminal as the crimp tooling member moves towards the anvil during a crimping operation to crimp the crimp barrel into mechanical and electrical engagement with an electrical wire disposed within the crimp barrel, wherein the top-forming surface includes a front flared section, a rear flared section, and an intermediary section disposed between the front flared section and the rear flared section along a longitudinal axis of the crimp tooling member that extends between opposite front and rear sides of the crimp tooling member, each of the front and rear flared sections angled transverse to the intermediary section along a longitudinal cross-sectional profile of the crimp tooling member, wherein the front flared section differs from the rear flared section in axial length and in angle of orientation relative to the intermediary section, wherein the forming profile defines a pocket along the intermediary section of the top-forming surface, the pocket configured to form a protrusion in the crimp barrel of the terminal during the crimping operation, the intermediary section including a front portion that is between the front flared section and the pocket along the longitudinal axis, the intermediary section including a rear portion that is between the rear flared section and the pocket along the longitudinal axis, and wherein the pocket along the intermediary section of the top-forming surface is a first pocket, and the forming profile further defines a second pocket disposed along one of the front or rear flared sections.

19. The crimping device of claim 18, wherein the front and rear portions of the intermediary section linearly extend parallel to each other along the longitudinal cross-sectional profile of the crimp tooling member.

* * * * *